US006383028B1

(12) United States Patent
Chang

(10) Patent No.: US 6,383,028 B1
(45) Date of Patent: May 7, 2002

(54) SIGNAL LINE ADAPTING SOCKET

(76) Inventor: Hsi-Fan Chang, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/669,922

(22) Filed: Sep. 27, 2000

(51) Int. Cl.[7] ..... H01R 25/00
(52) U.S. Cl. ..... 439/638; 439/676
(58) Field of Search ..... 439/638, 676, 439/639, 686, 695, 654, 628, 344

(56) References Cited

U.S. PATENT DOCUMENTS 4,268,109 A * 5/1981 Hardesty ..... 439/676
4,806,117 A * 2/1989 Johnston ..... 439/676
4,904,209 A * 2/1990 Nelson ..... 439/676
6,113,432 A * 9/2000 Liao ..... 439/676
6,146,207 A * 11/2000 Mulot ..... 439/344

* cited by examiner

*Primary Examiner*—Hien Vu
(74) *Attorney, Agent, or Firm*—Troxell Law Office PLLC

(57) ABSTRACT

A signal adapting socket, more particularly an adapting socket for the extension of telephone lines, has an adapting socket and two guiders. The adapting socket is a rectangular plate having a plurality of grooves. Metallic wires are inlaid into the grooves connecting the ends of the adapting socket, with the metallic wires bent relative to the upper side of the adapting socket. The guiders have rectangular shapes with two bottom guiding protrusions in the interior. The two guiders are separately installed at each end of the adapting socket with the metallic wires in the spaces between each isolating bracket.

1 Claim, 4 Drawing Sheets

SIGNAL LINE ADAPTING SOCKET

BACKGROUND OF THE INVENTION

1. Field of the Invention

The present invention relates to a signal line adapter, more particularly to a telephone adapter having two sockets connected to each other and totally covering the adapting socket. A signal line adapting socket design uses two rectangular guiders securely mounted to an adapting socket, the two guiders being connected to each and totally covering the adapting socket. It simplifies the manufacturing procedure due to the simple guiding structure of the adapting socket and provides a convenient installation for users by its simple guiding mounting.

2. Description of the Prior Art

The structure of the traditional telephone line connector is shown in FIG. 1 and comprises two main members 10, two sockets 20 and a conducing wire 30. The sockets 20 have flexible metal terminals 201 and a plurality of conducting wires 30 separately connected to the metal terminals 201. The two terminal sockets 20 are separately inserted into the two main members 10, and the two main members 10 are glued or combined by supersonic bonding to compose the telephone connecting socket. We learn from this prior art that each of the conducting wires is soldered to the terminal 201 and the manufacturing procedure is cumbersome. So many components for this structure not only increases the cost, but also makes the assembling more complicated. It is considered to be a design with many shortcomings.

Another structure of a telephone connector is shown in Taiwan utility model patent No. 87211147 which comprises a contractible base and an upper lid wherein each of the lateral sides at the bottom of the upper lid has a protruding latch engaging a latching hole at each of the lateral sides of the base. The designed structure of a larger latching hole allows the up and down flexible movement and reduces the volume of the connector for an easy carrying and storage. However, the latch is set at the lateral side of the center of the lid only, and when it is assembled for use, we generally insert a telephone line into one of the ends of the socket making the upper lid tilt upward at the inserting end. This shortens the inserting hole on the other side which makes it difficult to connect the telephone line on the other side. The tiling part easily causes the latch to break. This structure does not meet the reliability and safety standard for securely installing the telephone lines.

In view of the above description, the inventor of the present invention based on years of experience in the related industry conducted extensive research to enhance the telephone line adapting socket.

SUMMARY OF THE INVENTION

Therefore, the primary objective of the present invention is to provide a design for a signal line adapting socket including bending a predetermined number of metal wires and hooking them into an adapting socket, having hooking teeth disposed on both lateral sides, and inserting the telephone line connector into two guiders, thereby forming a secure structure in the shape of a rectangular cuboid. The two guiders are separately inserted on each end of the adapting socket and form an inserting connection and a secure structure for the adapting socket. It allows users to insert the telephone line into the end of the telephone socket very easily, and meets the economic effectiveness by providing a simple manufacturing procedure.

Another objective of the present invention is to provide a signal adapting socket design, wherein the two guiders have a latching structure between them to facilitate direct connection during the assembly of the socket. It improves the prior art by saving the trouble of gluing and combining by supersonic welding in the manufacturing procedure.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
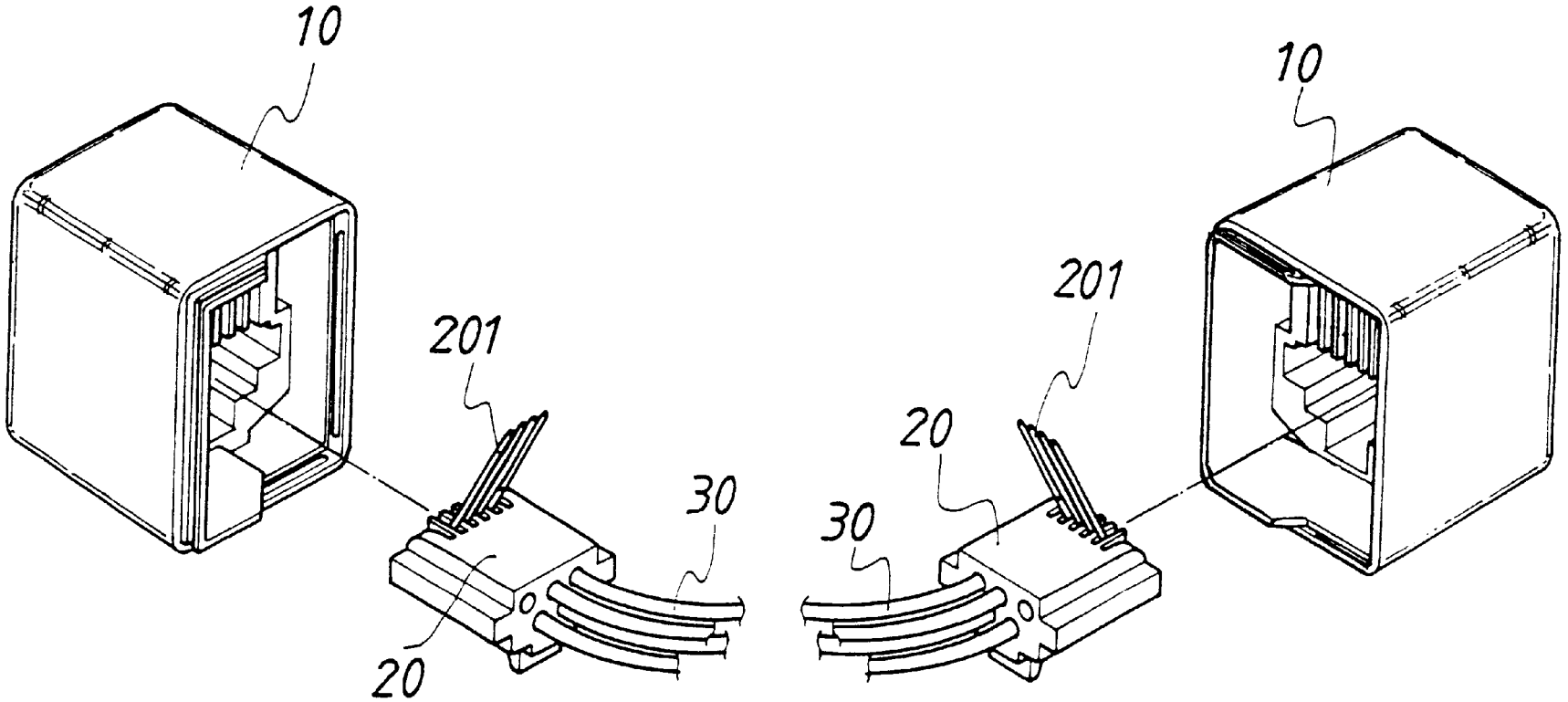
FIG. 1 Prior Art
FIG. 1 is an exploded view of the conventional telephone socket.
Figure 2:
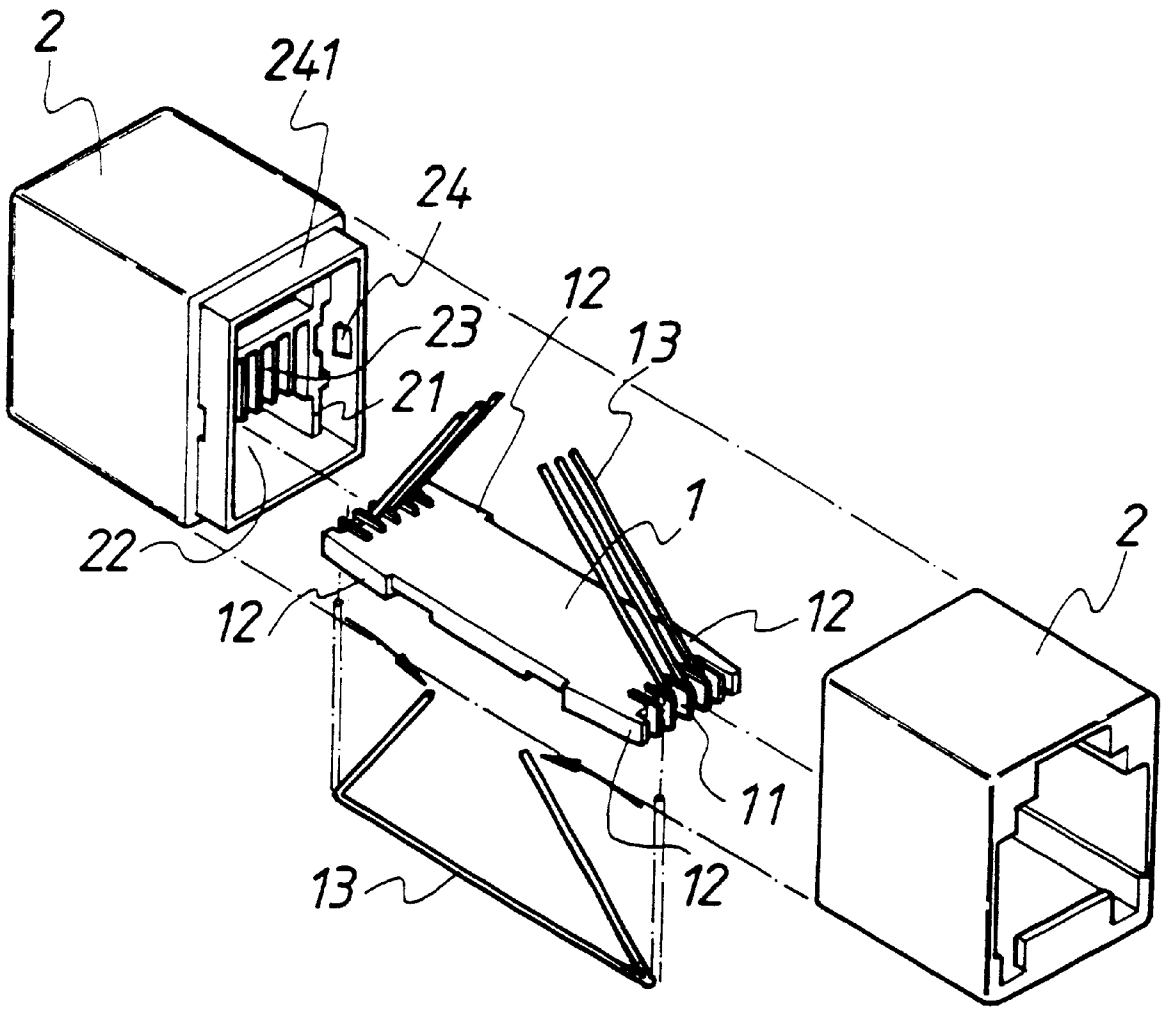
FIG. 2 is an exploded perspective view of the present invention.
Figure 3:
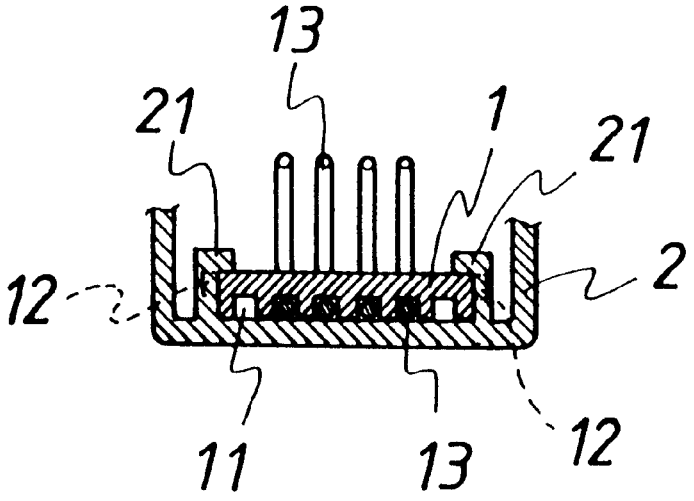
FIG. 3 is a transverse cross-sectional view of the present invention.

As shown in FIG. 2, the signal line adapting socket according to the present invention comprises an adapting socket 1 and two guiders 2, wherein said adapting socket is made of insulating material, such as plastic, in the shape of a rectangular plate, having a plurality of mutually parallel grooves 11 on both ends, and a protruding latch 12 disposed on the lateral side of each end. Metallic wire 13 is set in each of said inlaid grooves, and each of the metallic wire lines up and extends to both ends of said adapting socket 1. Each metallic wire 13 is bent aslant to the upper portion of said adapting socket structure 1. Each guider 2 is made of insulating material such as plastic, and forms a hollow rectangular cuboid with openings on both ends with an internal wall having the shape of a telephone line plug. Guiding protrusions 21 are located on the bottom lateral sides of the internal wall to form a guiding groove 22 between the two guiding protrusions 21. A plurality of isolating plates 23 are located at the upper portion of the internal wall. A first of the two guiders 2 has a protruding wall 241 with a protruding reverse-hooked latch 24 disposed at each of the lateral sides of the protruding wall 241. A latching groove 25 is formed at both lateral sides of the isolating board 23 of the second of the two guiders, such that, when the guiders are connected to each other, the latch of the first guider hooks into the latching groove of the second guide and securely connects the guiders to each other.

Figure 4:
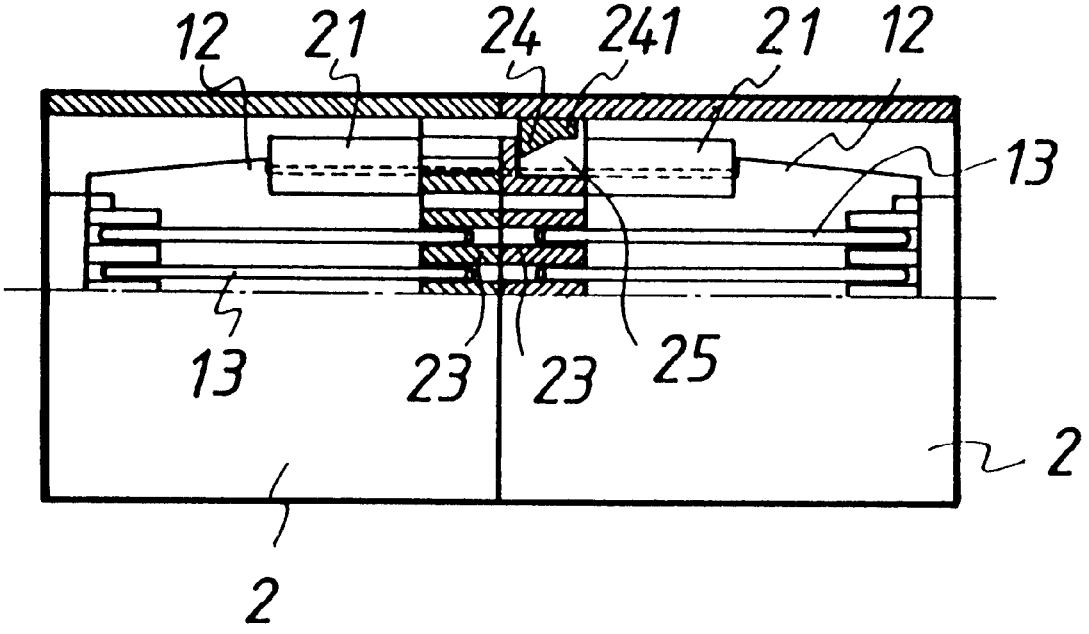
FIG. 4 is a longitudinal cross-sectional view of the present invention.
Figure 5:
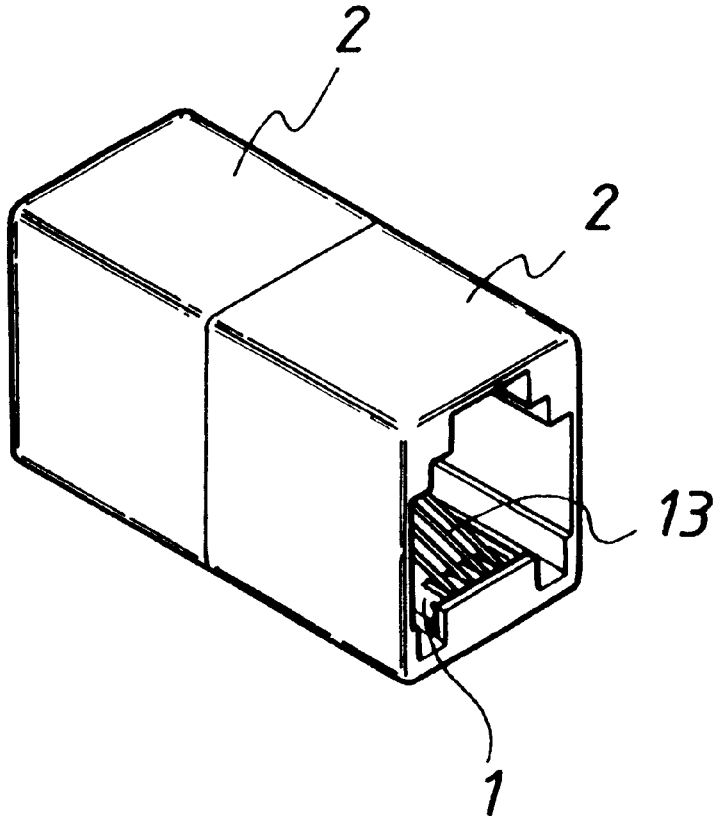
FIG. 5 is a perspective view of the present invention.

To assemble this structure each end of the adapting socket 1 is fit in the guiding groove 22 formed by two guiding protrusions 21, such that the slanted metallic wires 13 above the adapting socket fit between isolating boards 23, and the latch 12 on the lateral side of the adapting socket 1 hooks into the external ends of the guiding protrusions 21 as shown in FIG. 4. In addition, by hooking the latch 24 of the first guider 2 into the latching groove 25 of the second guider, a structure with a secure connection of the two guiders is formed as shown in FIG. 5. The structure is especially applicable to plugs and sockets of telephone extension lines.

Since this invention uses the metallic wire 13 directly bent into a hook and forms a connecting structure at the adapting socket, therefore the design of the present invention is much simpler than the foregoing conventional telephone line connector, and it can effectively simplify the manufacturing and assembly procedure. The two guiders 2 disposed on ends of the adapting socket 1 and the latch 12 of the adapting socket 1 hooks into the guiding protrusions 21 inside the guiders 2 allowing for a fast connection for assembly. When the present invention is assembled, there will be no tilting on one side of the upper lid of the socket. Both sides of the socket according to the present invention give a smooth installation for the telephone lines and there is no risk of breaking the socket due to the tilting. Furthermore, this invention uses the structure of the latch 24 of one of the guiders 2 and the latching groove 25 of the other guider to form supplementary connection when the two guiders are connected in the assembly. Such an arrangement makes the connection of the whole assembly very secure.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A signal line adapting socket assembly comprising:

a) an adapter socket made of insulating material and including a planar plate with two opposite ends, each opposite end having a plurality of grooves therein, the planar plate having a first surface, and a plurality of metallic wires extending on a second suface which is opposite to said first surface and along a length of the planar plate, said wire engaging groove in each of said wires, each of said wires having opposite end portions bent toward each other at said two opposite ends and at an acute angle to the first surface, the adapter socket having opposite lateral sides, each lateral side having two protruding latches;

b) a first guider made of insulating material and having a rectangular cuboid configuration with openings in two opposite faces, the first guider including two spaced apart interior first guiding protrusions defining a first guiding groove therebetween including a plurality of first parallel isolating plates and a protruding wall protruding from a face of the first guider and extending around one of the openings in the face, the protruding wall having at least one hook latch thereon, a first end of the adapter socket inserted into the one openings in the face of the guider having the protruding wall and the first end is located in the first guiding groove such that the first guiding protrusions are engaged by the protruding latches to attach the adapter socket and first guider together; and, c) a second guider made of insulating material and having a rectangular cuboid configuration with openings in two opposite faces, the second guider including two spaced apart, interior, second guiding protrusions defining a second guiding groove therebetween, a plurality of second parallel isolating plates and at least one latching groove, a second end of the adapter socket inserted into one of the openings such that second guiding protrusions are engaged by the protruding latches so as to attach the adapter socket and second guider together, and the protruding wall of the first guider extends into the second guider such that the at least one hook latch engages the at least one latching groove to attach the first and second guiders together whereby the adapter socket is enclosed by the guiders.

* * * * *